US009415490B2

(12) United States Patent
Cheng

(10) Patent No.: US 9,415,490 B2
(45) Date of Patent: Aug. 16, 2016

(54) MOUNTING STRUCTURE FOR A HAND TOOL

(71) Applicant: Chin-Shun Cheng, Taichung (TW)

(72) Inventor: Chin-Shun Cheng, Taichung (TW)

( * ) Notice: Subject to any disclaimer, the term of this patent is extended or adjusted under 35 U.S.C. 154(b) by 248 days.

(21) Appl. No.: 14/225,490

(22) Filed: Mar. 26, 2014

(65) Prior Publication Data

US 2015/0273670 A1 Oct. 1, 2015

(51) Int. Cl.
*B25B 23/00* (2006.01)
*B25B 13/06* (2006.01)

(52) U.S. Cl.
CPC ..... *B25B 23/0035* (2013.01); *B25B 13/06* (2013.01); *B25B 13/065* (2013.01)

(58) Field of Classification Search
CPC .... B25B 13/06; B25B 13/065; B25B 23/0035
USPC ..... 81/121.1, 124.6
See application file for complete search history.

(56) References Cited

U.S. PATENT DOCUMENTS 4,867,017 A * 9/1989 Holman ..... B25B 27/0042 7/100
7,523,688 B2 * 4/2009 Putney ..... B25B 13/065 76/114
2008/0289455 A1 * 11/2008 Goss ..... B25B 13/065 81/121.1
2012/0031242 A1 * 2/2012 Li ..... B25B 13/06 81/121.1

* cited by examiner

*Primary Examiner* — Hadi Shakeri

(57) ABSTRACT

A mounting structure of a hand tool includes a cylindrical body which has a mounting portion formed on one open end thereof. Multiple protrusions and recesses are formed in the inner periphery of the mounting portion. Each protrusion is connected to each of the adjacent recesses by a first conjunction line. A first face is defined annularly in the mounting portion. A second face is defined in one end of each protrusion. The first face intersects the second faces. The first face is located closer to the open end of the body than the second faces. The first and second face each are an inclined face relative to the open end of the body. The first angle is different from the second angle. A support portion extends from an edge of the first face so as to bear a larger torque.

13 Claims, 18 Drawing Sheets

MOUNTING STRUCTURE FOR A HAND TOOL

BACKGROUND OF THE INVENTION

1. Fields of the Invention

The present invention relates to a mounting structure, and more particularly, to a mounting structure of a hand tool so as to rotate an object.

2. Descriptions of Related Art

The conventional mounting structures are disclosed in FIGS. 19 to 22. The cylindrical body 20 has a mounting portion 21 formed in the first end thereof and the mounting portion 21 includes twelve recesses defined in the inner periphery of the first end of the body 20. Another mounting portion is formed in the second end of the body 20 and includes four recesses 22. The mounting portion 21 is used to mount an object so as to rotate the object. The mounting portion 21 has an annular inclined face 23 defined in one end thereof. An angle 24 is formed between the inclined face 23 and the end face of the body 10. Generally, the angle 24 is located within the range between 30 to 60 degrees. As shown in FIG. 22, when the mounting portion 21 is mounted to an object and the body 20 is rotated, the maximum stress between the mounting portion 21 and the object is applied to the end of the mounting portion 21, the stress is delivered along the direction as shown by the arrow heads. The direction is almost parallel to the inclined face 23. In other words, the inclined face 23 bears most of the stress that applies to the mounting portion 21. However, the area of the inclined face 23 is not big enough so that the inclined face 23 cannot bear a large torque.

The present invention intends to provide a mounting structure of a hand tool to improve the shortcomings mentioned above.

SUMMARY OF THE INVENTION

The present invention relates to a mounting structure of a hand tool and includes a cylindrical body which has a mounting portion formed on the first end thereof. Multiple protrusions and recesses are formed in the inner periphery of the mounting portion. Each protrusion is connected to each of the adjacent recesses by a first conjunction line. A first face is defined annularly in the mounting portion. A second face is defined in one end of each protrusion. The first face intersects the second faces. The first face intersects the second faces at an angle. The first face is located closer to the first end of the body than the second faces. A first angle is defined between the first face and the first end of the body. The first angle is equal or less than 90 degrees. A second angle is defined between the second face and the first end of the body. The second angle is less than 90 degrees. The first angle is different from the second angle. The first face is located closer to the open end of the body than the second faces. The first and second face each are an inclined face relative to the open end of the body. The first angle is different from the second angle. A support portion is integrally formed on the end face of the open end of the body. The support portion extends from an edge of the first face so as to bear a larger torque.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
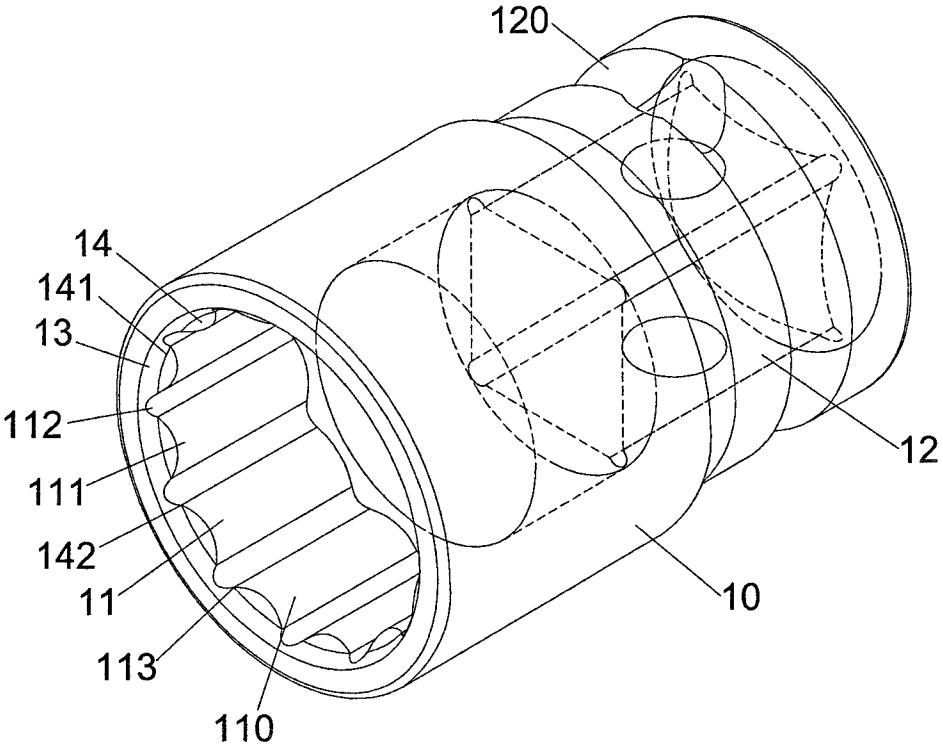
FIG. 1 is a perspective view to show the mounting structure of the present invention.
Figure 3:
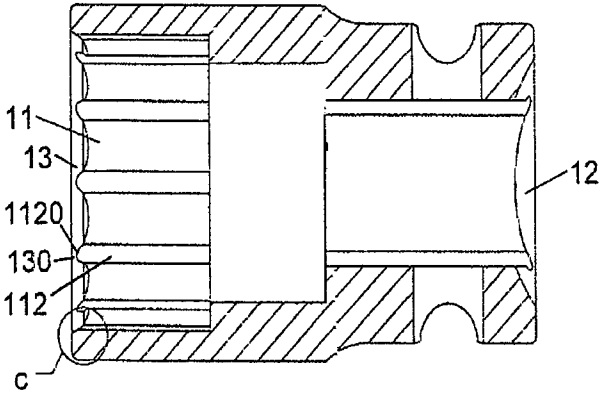
FIG. 3 is a cross sectional view, taken along line 3-3 of FIG. 2.

Referring to FIGS. 1 to 4, the mounting structure of the present invention comprises a cylindrical body 10 which is a socket used with an electric tool or pneumatic tool. The body 10 has a mounting portion 11 formed on the first end thereof, and the mounting portion 11 is located parallel to the axis of the body 10. A driving portion 12 is formed at the second end of the body 10. Multiple protrusions 111 and multiple recesses 112 are alternatively formed in the inner periphery of the mounting portion 11. Each of the protrusions 111 and the recesses 112 extend parallel to the axis of the body 10. The protrusions 111 each have a curved and convex surface which extends along a straight line which is parallel to the axis of the body 10. The recesses 112 each have a curved and concaved surface which extends along a straight line which is parallel to the axis of the body 10. Each of the protrusions 111 is connected to each of the recesses 112 adjacent thereto by a first conjunction line 113 which is parallel to the axis of the body 10. A rectangular recess is formed in the driving portion 12 of the body 10. An annular groove 120 is defined in the n outer periphery of the second end of the body 10. The mounting portion 11 has an opening 110 located at the first end of the body 10. A first face 13 is defined annularly in the inner periphery of the opening 110 of the mounting portion 11. The first face 13 is connected to one end of each of the protrusions 111 and the recesses 112. A second face 14 is defined in one end of each protrusion 111 and located in the opening 110. The first face 13 intersects the second faces 14 at an angle. The first face 13 is located closer to the first end of the body 10 than the second faces 14. The first face 13 is an inclined face, and each of the second faces 14 is an inclined face.

Figure 4:
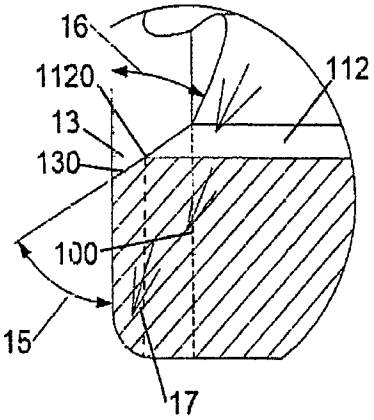
FIG. 4 is an enlarged view to show the circle C of FIG. 3.

As shown in FIG. 4, a first angle 15 is defined between the first face 13 and the first end face 100 of the body 10 (the first end face 100 of the body 10 is vertical with respect to the axis of the body 10). The first angle 15 is less than 90 degrees. A second angle 16 is defined between the second face 14 and the first end face of the body 10. The second angle 16 is less than 90 degrees. The first angle 15 is different from the second angle 16. The first angle 15 is larger than the second angle 16. The first angle 15 is 30 to 60 degrees, and the second angle 16 is 20 to 50 degrees. The first angle 15 is 1.5 to 2.5 times of the second angle 16. Preferably, the ratio between the first angle 15 and the second angle 16 is 5/3 or 2/1. A second conjunction line 141 is formed between the first face 13 and each of the second faces 14 of the protrusion 111. Each of the second conjunction lines 141 intersects the first conjunction line 113 corresponding thereto at a conjunction point 142. A support portion 17 is integrally formed on the end face of the first end of the body 10. The support portion 17 extends radially from an edge of the first face 13.

Figure 2:
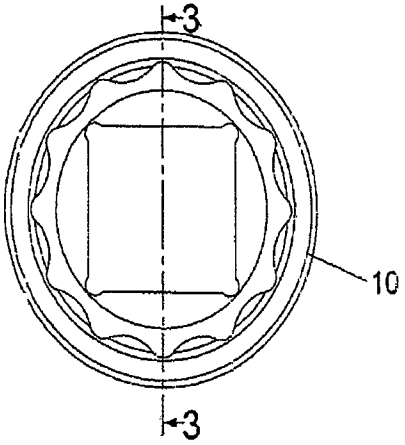
FIG. 2 shows the front view of the mounting structure of the present invention.

As shown in FIG. 4, when the mounting portion 11 rotates an object, the stress is mostly applied to the mounting portion 11 so that the torque is transferred from the second face 14 to the first face 13. Because of the support portion 17 which extends radially from the edge of the first face 13, so that the body 10 is able to transfer a larger torque to the object. Referring to FIGS. 2 and 4, a gap 130 defined on the first face 13 between a tip 1120 of one end of the recess 112 and the first end face 100.

Figure 5:
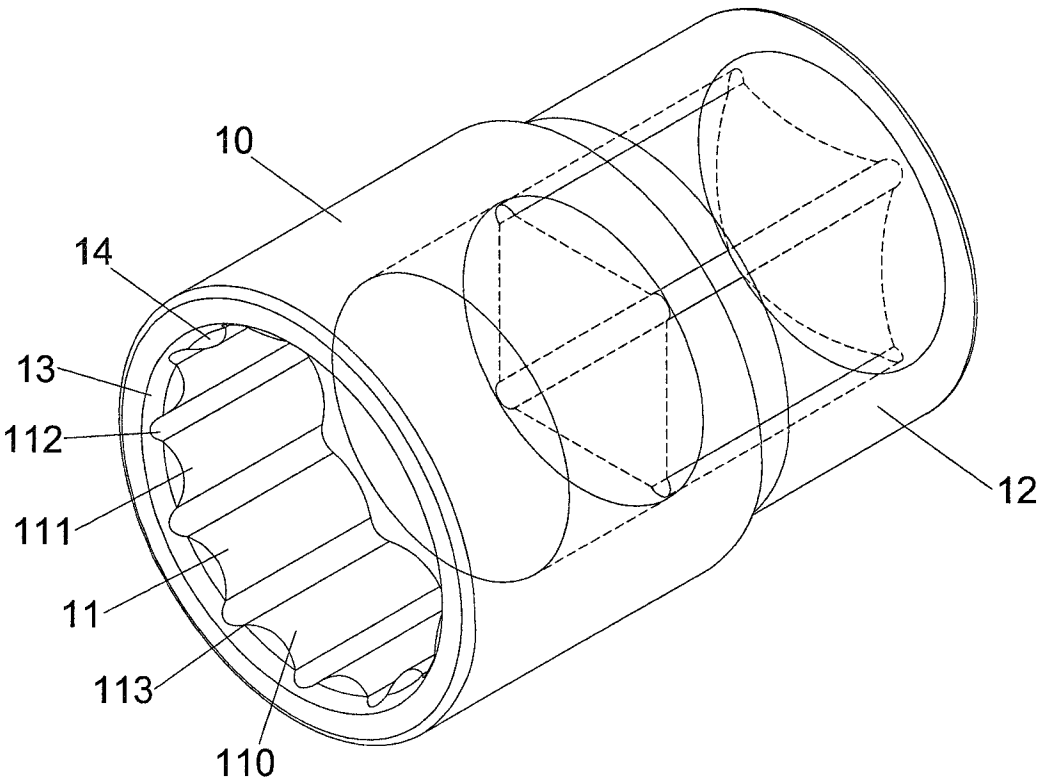
FIG. 5 is a perspective view to show the second embodiment of the mounting structure of the present invention.

FIG. 5 shows the second embodiment of the mounting structure of the present invention, wherein the body 10 is a socket and has a rectangular recess defined in the second end of the body 10.

Figure 6:
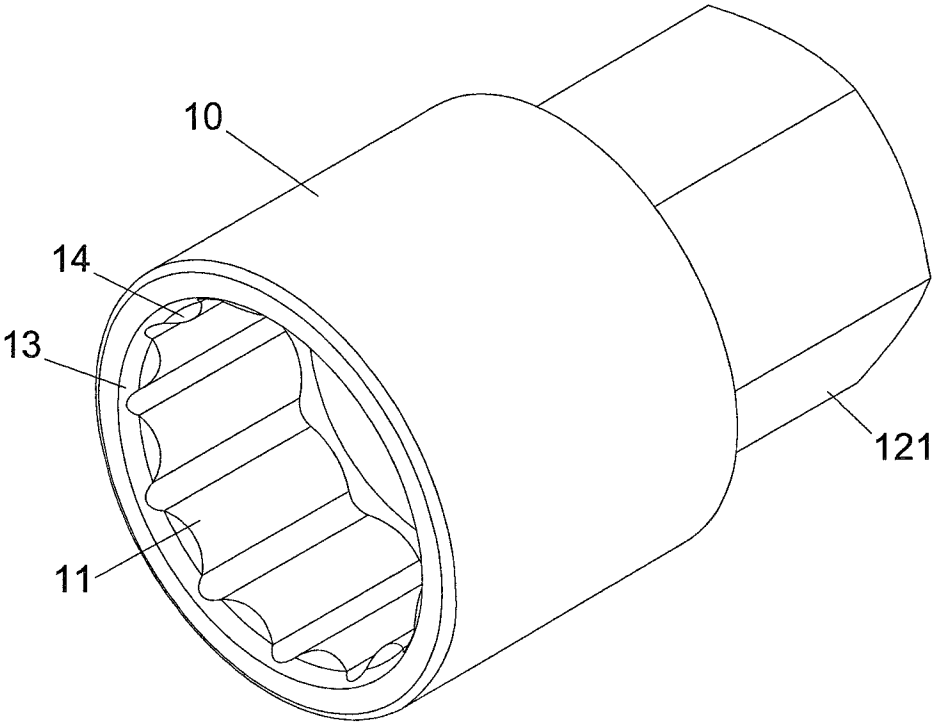
FIG. 6 is a perspective view to show the third embodiment of the mounting structure of the present invention.

FIG. 6 is a perspective view to show the third embodiment of the mounting structure of the present invention, wherein the body 10 is a socket 121 with two open ends.

Figure 7:
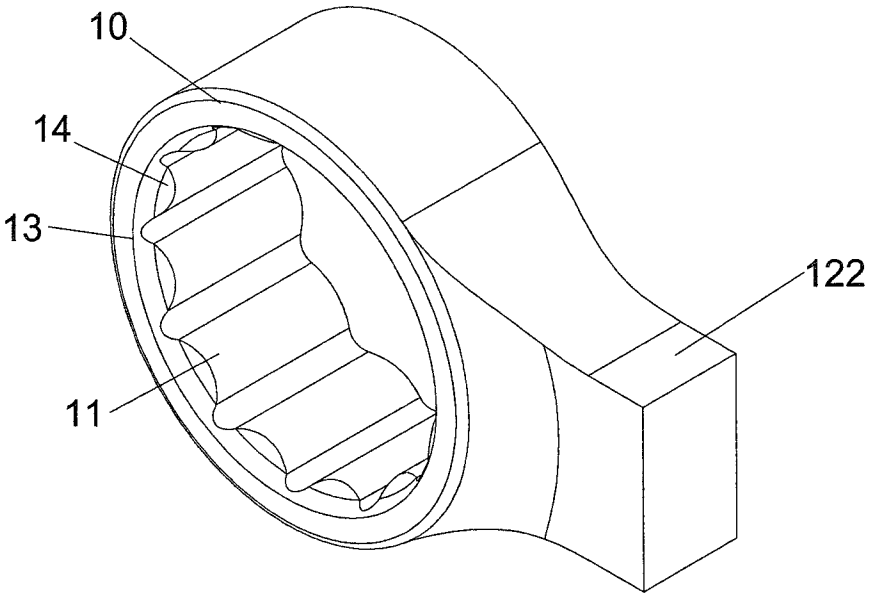
FIG. 7 is a perspective view to show the fourth embodiment of the mounting structure of the present invention.

FIG. 7 is a perspective view to show the fourth embodiment of the mounting structure of the present invention, wherein the body 10 is a driving head of a wrench 122.

Figure 8:
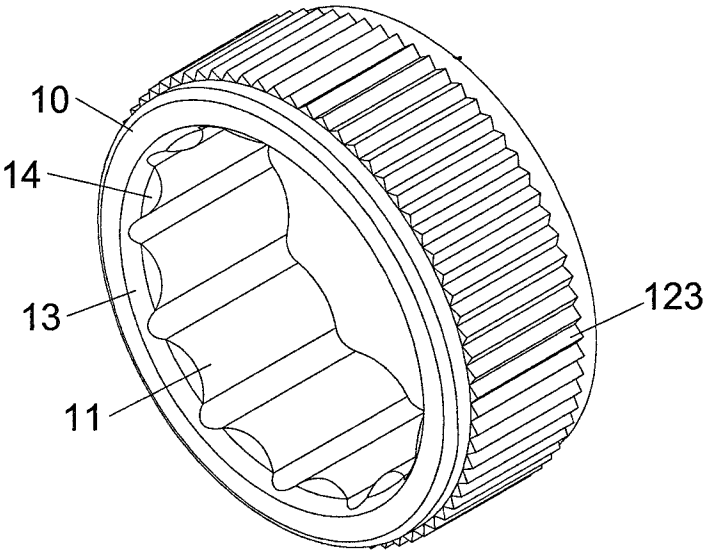
FIG. 8 is a perspective view to show the fifth embodiment of the mounting structure of the present invention.

FIG. 8 is a perspective view to show the fifth embodiment of the mounting structure of the present invention, wherein the body 10 is a ratchet wheel 123.

Figure 9:
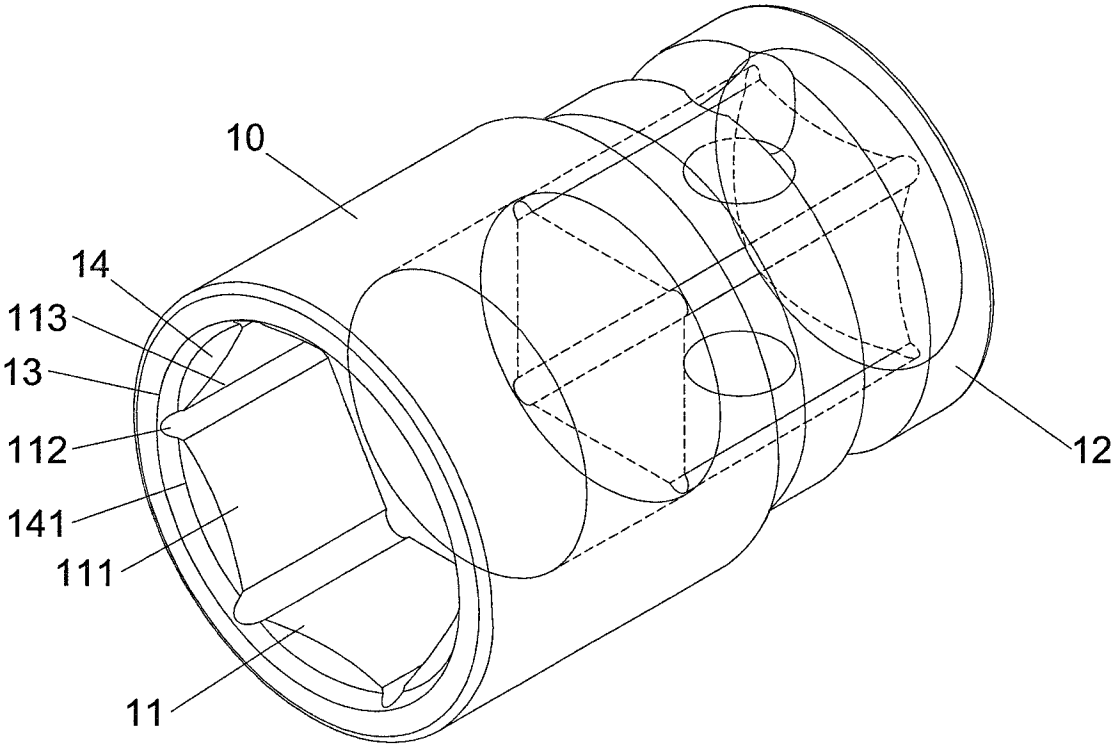
FIG. 9 is a perspective view to show the sixth embodiment of the mounting structure of the present invention.

FIG. 9 is a perspective view to show the sixth embodiment of the mounting structure of the present invention, wherein the mounting portion 11 of the body 10 is a hexagonal recess which has six protrusions 111 and six recesses 112. The first conjunction line 113 does not intersect the second conjunction line 141.

Figure 10:
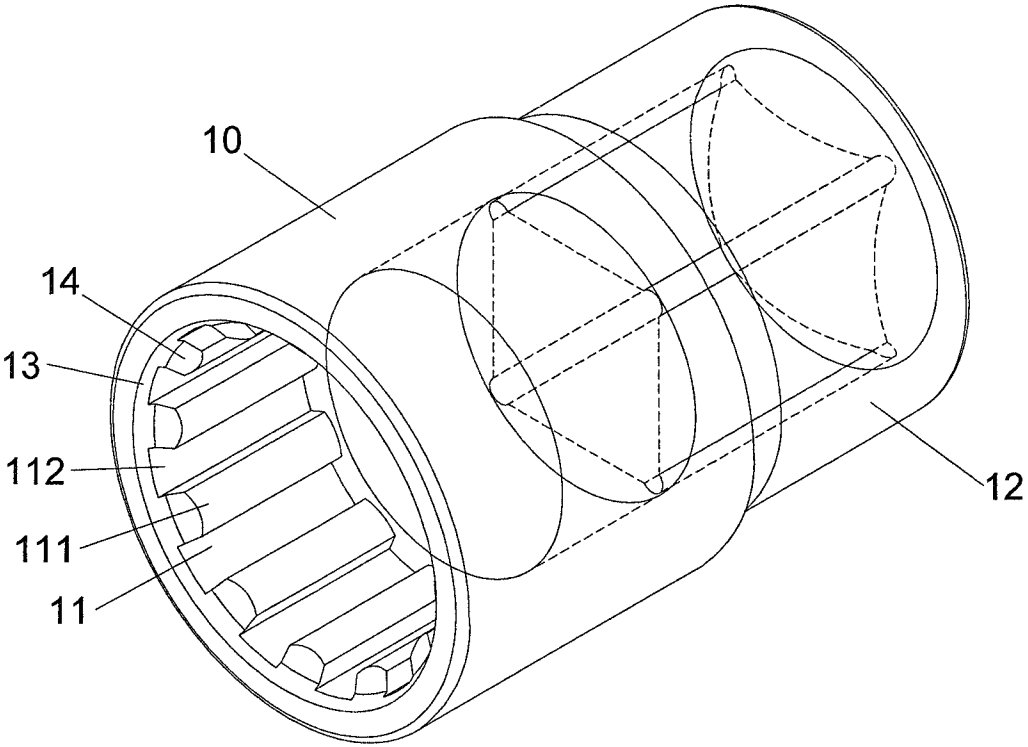
FIG. 10 is a perspective view to show the seventh embodiment of the mounting structure of the present invention.

FIG. 10 is a perspective view to show the seventh embodiment of the mounting structure of the present invention, wherein the mounting portion 11 of the body 10 is a gear-type socket which has twelve protrusions 111 and twelve recesses 112. Each of the protrusions 111 has two bent sides.

Figure 11:
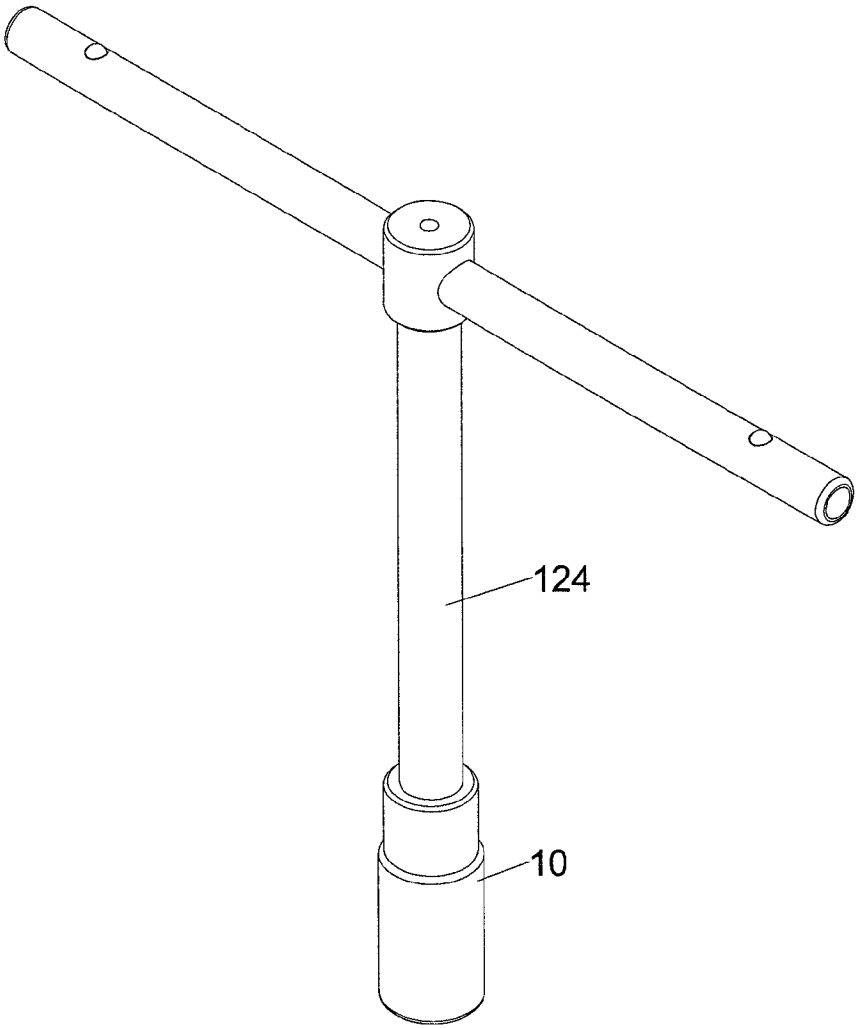
FIG. 11 is a perspective view to show the eighth embodiment of the mounting structure of the present invention.

FIG. 11 is a perspective view to show the eighth embodiment of the mounting structure of the present invention, wherein the body 10 is a driving head connected with a rod 124.

Figure 12:
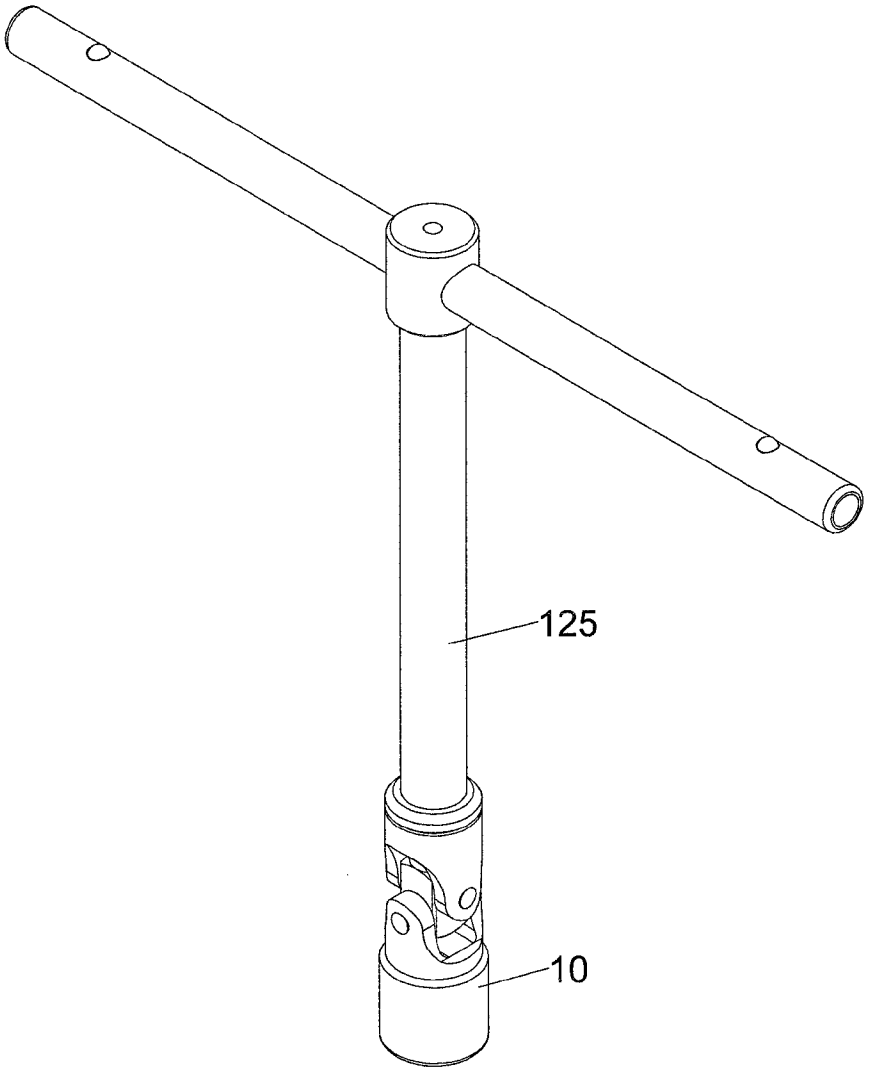
FIG. 12 is a perspective view to show the ninth embodiment of the mounting structure of the present invention.

FIG. 12 is a perspective view to show the ninth embodiment of the mounting structure of the present invention, wherein the body 10 is a driving head on an universal connector which is connected to an end of a rod 125

Figure 13:
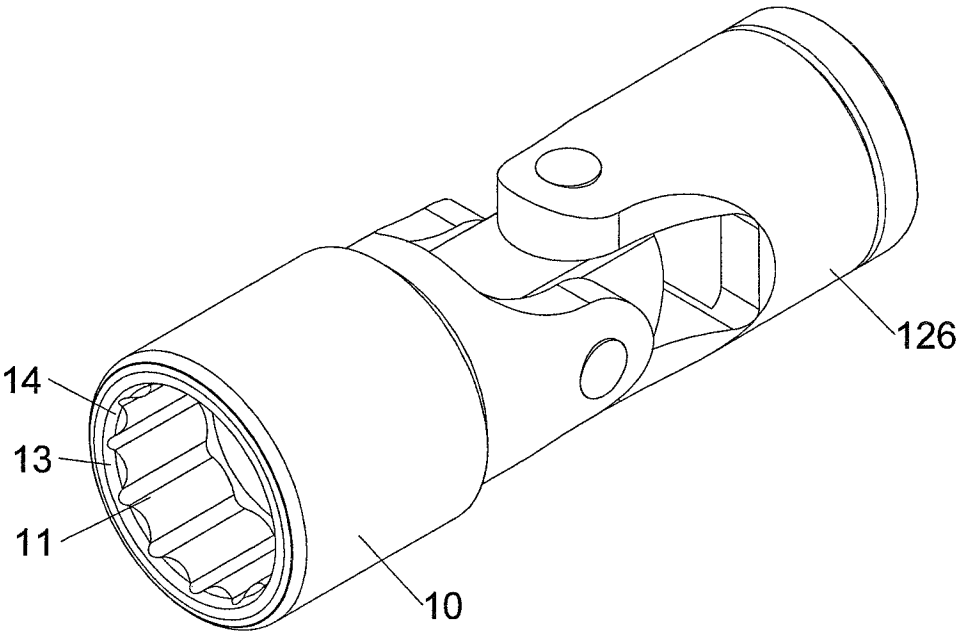
FIG. 13 is a perspective view to show the tenth embodiment of the mounting structure of the present invention.

FIG. 13 is a perspective view to show the tenth embodiment of the mounting structure of the present invention, wherein the body 10 is a driving head connected with a movable universal connector 126.

Figure 14:
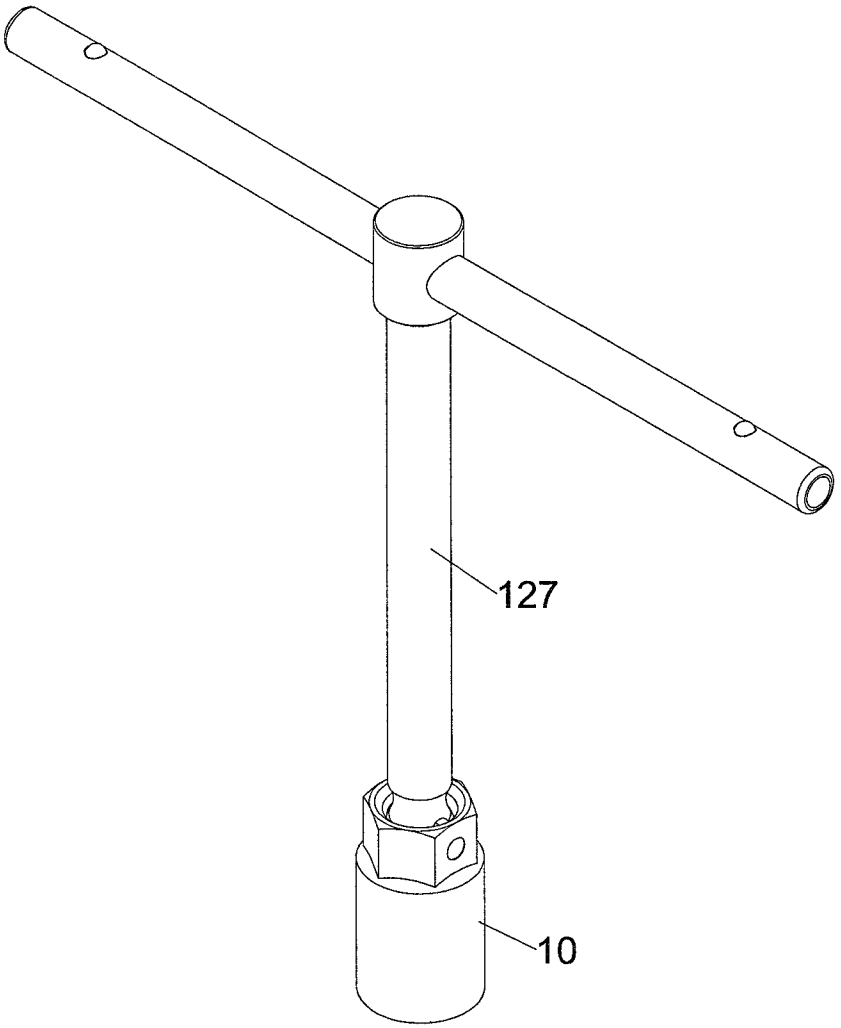
FIG. 14 is a perspective view to show the eleventh embodiment of the mounting structure of the present invention.

FIG. 14 is a perspective view to show the eleventh embodiment of the mounting structure of the present invention, wherein the body 10 is a driving head connected to a ball-type universal connector on an end of a rod 127.

Figure 15:
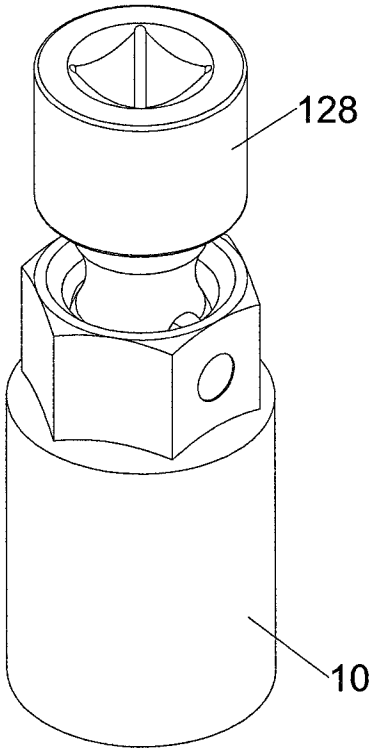
FIG. 15 is a perspective view to show the twelfth embodiment of the mounting structure of the present invention.

FIG. 15 is a perspective view to show the twelfth embodiment of the mounting structure of the present invention, wherein the body 10 is a driving head connected to a ball-type universal connector 128.

Figure 16:
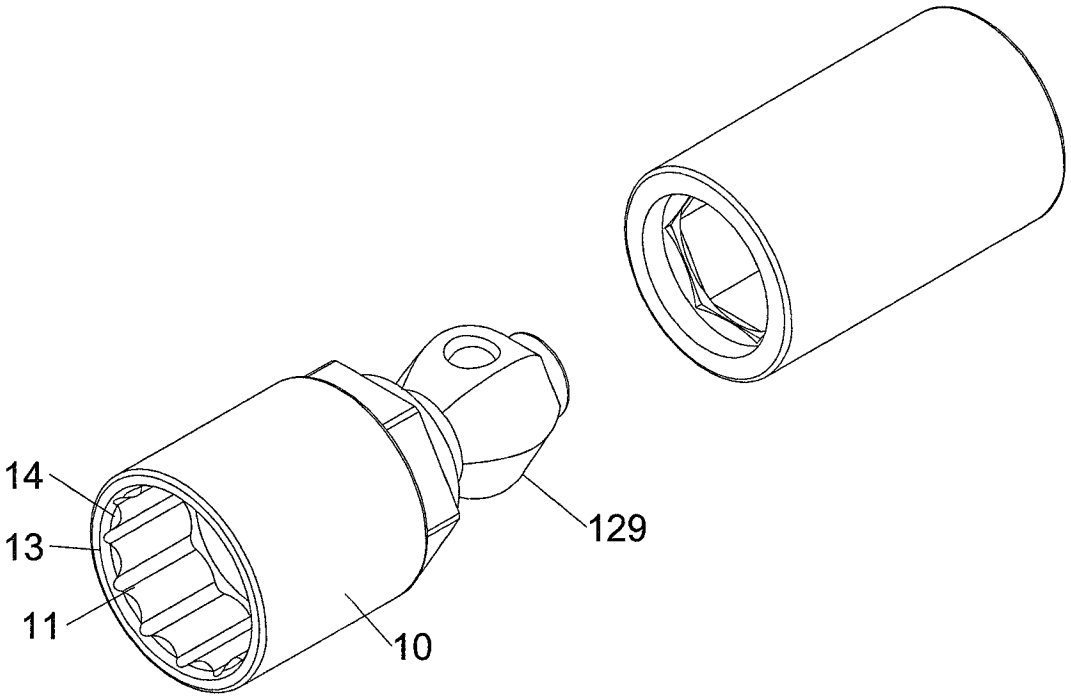
FIG. 16 is a perspective view to show the thirteenth embodiment of the mounting structure of the present invention.

FIG. 16 is a perspective view to show the thirteenth embodiment of the mounting structure of the present invention, wherein the body 10 is a driving head connected with a polygonal universal connector 129.

Figure 17:
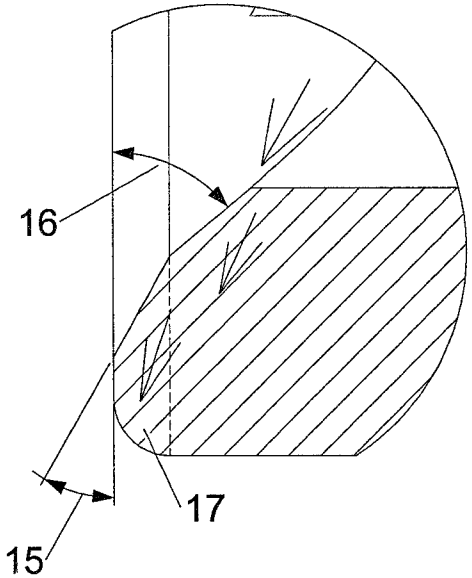
FIG. 17 is a perspective view to show the fourteenth embodiment of the mounting structure of the present invention.

FIG. 17 is a perspective view to show the fourteenth embodiment of the mounting structure of the present invention, wherein the first angle 15 is smaller than the second angle 16.

Figure 18:
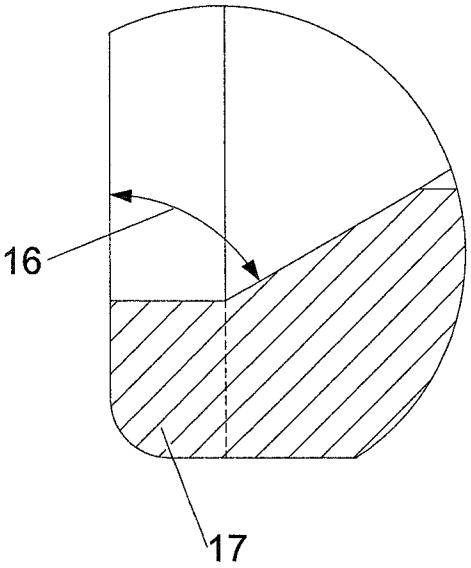
FIG. 18 is a perspective view to show the fifteenth embodiment of the mounting structure of the present invention.
Figure 19:
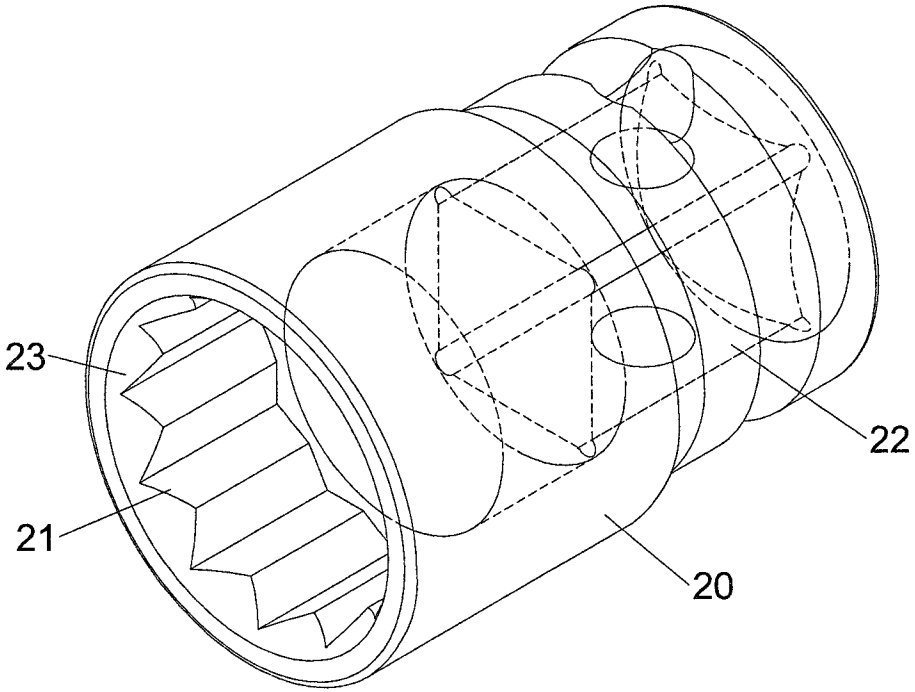
PRIOR ART FIG.19
FIG. 19 is a perspective view to show the conventional socket.
Figure 21:
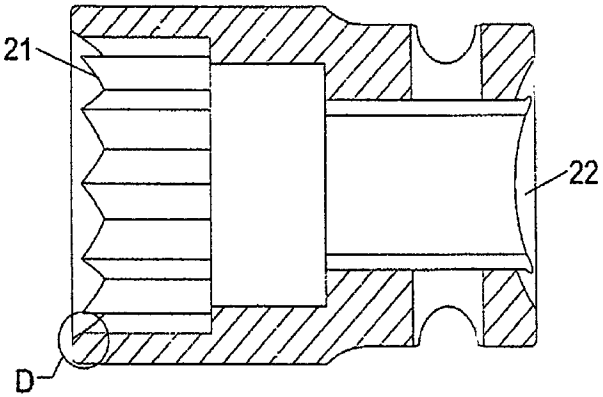
PRIOR ART FIG.21
FIG. 21 is a cross sectional view, taken along lint 21-21 of FIG. 20.
Figure 22:
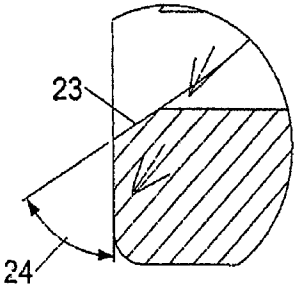
PRIOR ART FIG.22
FIG. 22 is an enlarged view to show the circle D of FIG. 21.
Figure 20:
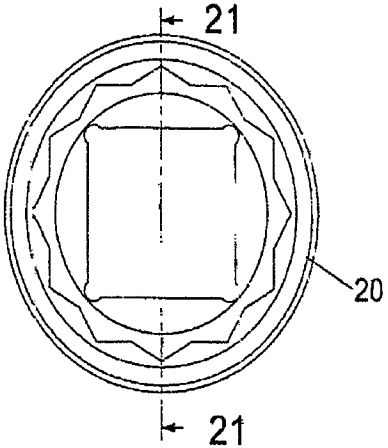
PRIOR ART FIG.20
FIG. 20 is a front view of the conventional socket.

FIG. 18 is a perspective view to show the fifteenth embodiment of the mounting structure of the present invention, wherein the first angle 15 is 90 degrees.

The advantages of the present invention are that when the mounting portion 11 of the body 10 rotates an object, the stress is mostly applied to the mounting portion 11 so that the torque is transferred from the second face 14 to the first face 13, and then is absorbed by the support portion 17. The body 10 can be used with a larger torque.

The first and second angles 15, 16 are different so that when the torque is transferred from the second face 14 to the first face 13, the angle that the torque is transferred to changes along with the change of the angle so that the body 10 can bear a larger torque and has a longer life of use.

While we have shown and described the embodiment in accordance with the present invention, it should be clear to those skilled in the art that further embodiments may be made without departing from the scope of the present invention.

What is claimed is:

1. A mounting structure of a hand tool, comprising:

a cylindrical body having a mounting portion formed on a first end thereof, the mounting portion located parallel to an axis of the body, multiple protrusions and multiple recesses alternatively formed in an inner periphery of the mounting portion, each of the protrusions and the recesses extending parallel to the axis of the body, each of the protrusions connected to each of the recesses adjacent thereto by a first conjunction line which is parallel to the axis of the body, the mounting portion having an opening located at the first end of the body, a first face defined annularly in an inner periphery of the opening of the mounting portion, the first face connected to an end of each of the protrusions and the recesses, a second face being defined in one end of each protrusion and located in the opening, the first face intersecting the second faces at an angle, the first face being located closer to the first end of the body than the second faces, a first angle defined between the first face and a first end face of the body, a second angle defined between the second face and the first end face of the body, the first angle being different from the second angle, wherein the first angle being larger than the second angle, the first angle being 30 to 60 degrees, the second angle being 20 to 30 degrees, the first angle being 1.5 to 2 times of the second angle, a second conjunction line is formed between the first face and each of the second faces of the protrusion, each of the second conjunction lines intersects the first conjunction line corresponding thereto at a conjunction point, a support portion integrally formed on the first end face of the first end of the body, the support portion extending from an edge of the first face.

2. The mounting structure as claimed in claim 1, wherein the protrusions each have a curved and convex surface, the recesses each having a curved and concaved surface.

3. The mounting structure as claimed in claim 1, wherein the first face is an inclined face, each of the second faces is an inclined face.

4. The mounting structure as claimed in claim 1, wherein the body is a socket which has the mounting portion at the first end thereof, a rectangular recess is formed in a second end of the body.

5. The mounting structure as claimed in claim 1, wherein the protrusions each have a curved and convex surface which extends along a straight line which is parallel to the axis of the body, the recesses each having a curved and concaved surface which extends along a straight line which is parallel to the axis of the body.

6. The mounting structure as claimed in claim 1, wherein the body is a socket for an electric hand tool or a pneumatic tool, the body has the mounting portion at the first end thereof, a rectangular recess is formed in a second end of the body, an annular groove is defined in an outer periphery of the second end of the body.

7. The mounting structure as claimed in claim 1, wherein a ratio between the first angle and the second angle is 5/3.

8. The mounting structure as claimed in claim 1, wherein a ratio between the first angle and the second angle is 2/1.

9. The mounting structure as claimed in claim 1, wherein the first angle is 50 degrees and the second angle is 30 degrees.

10. The mounting structure as claimed in claim 1, wherein the first angle is 60 degrees and the second angle is 30 degrees.

11. The mounting structure as claimed in claim 1, wherein the body is a socket with two open ends, a driving head of a wrench, a ratchet wheel or a gear-type socket, the mounting portion of the gear-type socket has twelve protrusions and twelve recesses, each of the protrusions has two bent sides.

12. The mounting structure as claimed in claim 1, wherein the number of the multiple protrusions and the multiple recesses are 6 respectively.

13. The mounting structure as claimed in claim 1, wherein the body is a driving head connected with a rod, a driving head on an universal connector which is connected to an end of a rod, a driving head connected with a movable connector, a driving head connected with an universal connector, a driving head connected to a ball-type universal connector on an end of a rod, or a driving head connected with a polygonal universal connector.

* * * * *